US006352338B1

(12) United States Patent
Komuro

(10) Patent No.: US 6,352,338 B1
(45) Date of Patent: Mar. 5, 2002

(54) INK-JET PRINT HEAD, PRODUCTION METHOD THEREOF, AND PRINTING APPARATUS WITH THE INK-JET PRINT HEAD

(75) Inventor: Hirokazu Komuro, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/897,952

(22) Filed: Jul. 24, 1997

Related U.S. Application Data

(62) Division of application No. 08/658,388, filed on Jun. 5, 1996, now abandoned, which is a continuation of application No. 08/170,783, filed on Dec. 21, 1993, now abandoned.

(30) Foreign Application Priority Data

Dec. 22, 1992 (JP) ..... 4-341975
Dec. 22, 1992 (JP) ..... 4-342028

(51) Int. Cl.[7] ..... B41J 2/05
(52) U.S. Cl. ..... 347/64
(58) Field of Search ..... 347/64, 42; 427/489, 427/988, 987

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,450,457 A | | 5/1984 | Miyachi et al. | 347/64 |
| 4,459,600 A | | 7/1984 | Sato et al. | 347/47 |
| 4,463,359 A | | 7/1984 | Ayata et al. | 347/56 |
| 4,513,298 A | | 4/1985 | Scheu | 347/64 |
| 4,558,333 A | | 12/1985 | Sugitani et al. | 347/65 |
| 4,577,202 A | | 3/1986 | Hara | 347/64 |
| 4,723,129 A | | 2/1988 | Endo et al. | 347/56 |
| 4,740,796 A | | 4/1988 | Endo et al. | 347/56 |
| 4,990,939 A | * | 2/1991 | Sekiya et al. | 347/62 |
| 5,063,655 A | * | 11/1991 | Lamey et al. | 347/64 |
| 5,081,474 A | * | 1/1992 | Shibata et al. | 347/59 |
| 5,218,754 A | * | 6/1993 | Rahgappan | 347/42 |
| 5,314,724 A | * | 5/1994 | Tskune et al. | 427/489 |

FOREIGN PATENT DOCUMENTS

| | | | |
|---|---|---|---|
| EP | 355998 | | 2/1990 |
| EP | 355998 A1 | | 2/1990 |
| JP | 54-51837 | | 4/1979 |
| JP | 54-56847 | | 5/1979 |
| JP | 59-123670 | | 7/1984 |
| JP | 59-138461 | | 8/1984 |
| JP | 60-234850 | | 11/1985 |
| JP | 62-45237 | | 2/1987 |
| JP | 62-45283 | | 2/1987 |
| JP | 62-45286 | | 2/1987 |
| JP | 4-34936 | * | 2/1992 |
| JP | 4-343456 | * | 11/1992 |
| WO | 9013430 | | 11/1990 |
| WO | 90/13430 | | 11/1990 |

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

There is disclosed an ink-jet print head comprising a heat acting portion communicated with a liquid discharge orifice, an electrothermal energy conversion element for generating thermal energy, and an upper protection layer, wherein the heat acting portion gives the thermal energy to the liquid so as to generate a bubble in the liquid, the upper protection layer being a film formed by means of chemical vapor deposition using an organic silicon source as a source material. There is also disclosed a method of producing such an ink-jet print head described above, in which the upper protection layer is formed by means of chemical vapor deposition using source gases including an organic silicon source, after forming the heat acting portion with a circuit pattern by means of photolithography. The ink-jet print head according to the present invention provides high performance in discharge durability and in thermal response.

11 Claims, 4 Drawing Sheets

INK-JET PRINT HEAD, PRODUCTION METHOD THEREOF, AND PRINTING APPARATUS WITH THE INK-JET PRINT HEAD

This application is a division of application Ser. No. 08/658,388 filed Jun. 5, 1996, now abandoned, which is a continuation of application Ser. No. 08/170,783 filed Dec. 21, 1993, now abandoned.

BACKGROUND OF THE INVENTION

1. Field of the Invention

The present invention relates to an ink-jet print head which discharges liquid through an orifice to form liquid droplets. More specifically, the present invention relates to an ink-jet print head which applies thermal energy to liquid to cause a state change in liquid to discharge liquid. The present invention also relates to a method of producing such a print head, and to a printing apparatus with this type of print head, such as a copy machine, facsimile machine, printer and textile printing device.

2. Related Background Art

Of various types of ink-jet print heads, the ink-jet printing method disclosed in Japanese Laid-Open Patent Application No. 54-51837 has a unique feature different from the other types of ink-jet printing methods in that liquid droplets are discharged upon application of the thermal energy to liquid. In the method disclosed in the application, the liquid is heated by means of thermal energy so as to generate a bubble, which creates the force to form the liquid droplet through an orifice at the leading end of the print head. Then the droplet is deposited on a recording medium to print information thereon.

In general, a print head applied to the above-mentioned method comprises an orifice through which liquid is discharged, a liquid discharge portion communicating with the orifice, having a liquid flow path including as a part a heat acting section for applying the thermal energy to the liquid to discharge the liquid droplets, a heat generating resistor as an electrothermal energy conversion element which is thermal energy generating means and an electrode, and an upper protecting layer for protecting the heat generating resistor and the electrode from ink.

The heat generating resistor, the electrode, and the upper protecting layer are generally formed by sequentially depositing as thin films on a substrate. The thin films can be formed by a technique such as sputtering or CVD (chemical vapor deposition).

If the heat generating resistor layer is in direct contact with the recording or printing liquid, electrical current may flow through the printing liquid in accordance with a value of the electric resistance of the printing liquid and the printing liquid may be electrolyzed due to electrical current through the printing liquid. In addition, the printing liquid reacts with the heat generating resistor layer upon energization of the heat generating resistor layer so that the heat generating resistor layer may be damaged or the resistance thereof may vary.

Conventionally, to solve the above problems and to improve the reliability and the durability for long-time repeated use a protection layer made of a high acid-resistance material such as $SiO_2$ on the heat generating resistor layer is provided so as to prevent the heat generating resistor layer from being in direct contact with the printing liquid.

To achieve the requirements such as prevention of the damage of the heating resistor layer and prevention of short-circuiting between the electrodes, the protection layer covering the thermal energy generating means should have no defects such as pin holes in the film so that the heating resistor layer and the major portions of the electrodes can be covered uniformly with the protection layer.

However, because the electrodes are formed on the heating resistor layer as described above, there are steps between the electrodes and the heating resistor layer. In conventional techniques of forming a thin film, it is difficult to form a uniform protection layer on the electrodes and on the heating resistor layer having such steps. The thickness of the protection film tends to be thinner at the steps as shown in FIG. 3, which may sometimes cause exposure of a portion of the electrodes or the heating resistor layer.

In such a state where the step coverage is not good enough, the exposed portion of the heating resistor layer may be in direct contact with the printing liquid. As a result, electrolysis of the printing liquid may occur, and reaction between the printing liquid and the heating resistor layer may occur, which may result in the damage of the heating resistor layer. Moreover, due to the fact that the thickness of the protection layer tends to be non-uniform near the step regions, thermal cycling induces the localized thermal stress in a part of the protection layer, which results in cracks in the protection layer. If such cracking occurs, the printing liquid may penetrate through the cracks to reach the heating resistor layer and thus the heating resistor layer may be damaged.

A common known way to solve such problems is to thicken the protection film so as to improve the step coverage and to reduce the pin holes. However, the thickening of the protection film causes another problem that the thermal resistance between the heating resistor layer and the bubbling surface increases, which results in low thermal response of the bubbling surface. Moreover, it becomes necessary to apply higher electrical power to the heating resistor layer, which causes low durability of the heating resistor layer. Thus, there has been the need to develop a technique which can form a protection layer having good step coverage without increasing the thickness of the protection layer.

There have been various attempts to achieve this requirement. For example, Japanese Laid-Open Patent Application No. 60-234850 discloses a bias sputtering technique which can form a protection film having good step coverage. Japanese Laid-Open Patent Application Nos. 62-45283, and 62-45237 disclose a technique in which the step coverage is improved by altering the shape of the steps by means of etching back or sputter-etching the protection film which has been already deposited. In the technology disclosed in Japanese Laid-Open Patent Application No. 62-45286, the protection film is re-flowed to improve the step coverage. In HP Journal, May, 1985, there is disclosed a technique in which electrodes are formed in a tapered shape to improve the step coverage.

However, each of these techniques has its own problems. For example, in bias sputtering, it is difficult to control the thickness of a film, and thus good reproducibility cannot be obtained. Another problem of this technique is that contamination or dust occurs around a target material. Etching back and sputter-etching techniques result in an increase in the number of processing steps, which further results in a decrease in throughput or production yields. On the other hand, re-flowing requires a high temperature which degrades the reliability of aluminum electrodes. In tapered-shape electrodes, it is difficult to obtain good uniformity and reproducibility in the tapered shape, which causes the variations in resistance value.

As described above, there are no conventional techniques which can form a high quality protection film applicable to an ink-jet head with a high production yield.

SUMMARY OF THE INVENTION

In view of the above, it is a major object of the present invention to provide a method of producing an ink-jet print head having good durability which can be produced by using common production processes.

It is another object of the present invention to provide a method of producing an ink-jet print head having good step coverage which can perform good thermal response.

It is still another object of the present invention to provide an ink-jet print head produced by the above production methods.

It is a further object of the present invention to provide a printing apparatus using the above ink-jet print head.

DETAILED DESCRIPTION OF THE PREFERRED EMBODIMENTS

Referring to figures, preferred embodiments of the present invention will be described below.

Figure 1:
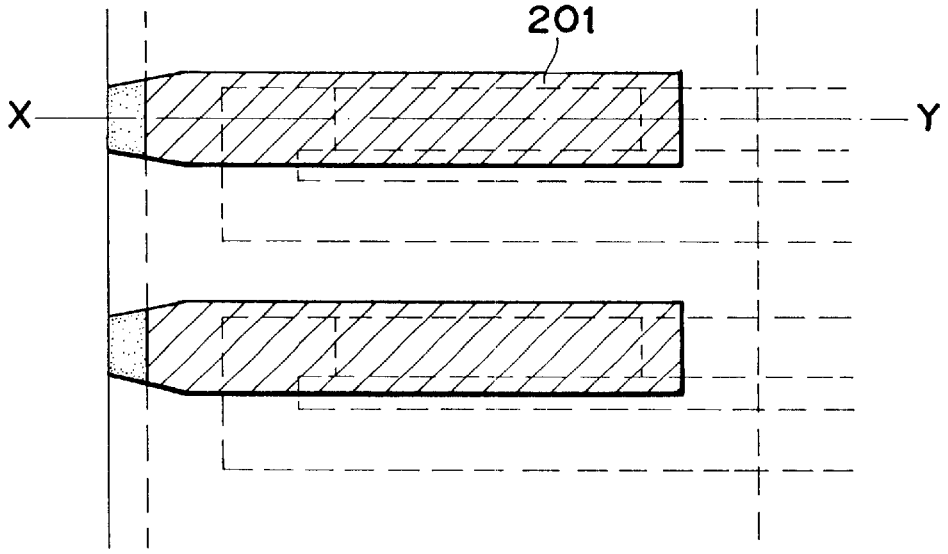
FIG. 1 is a schematic plan view of a heater board according to the present invention.
Figure 2:
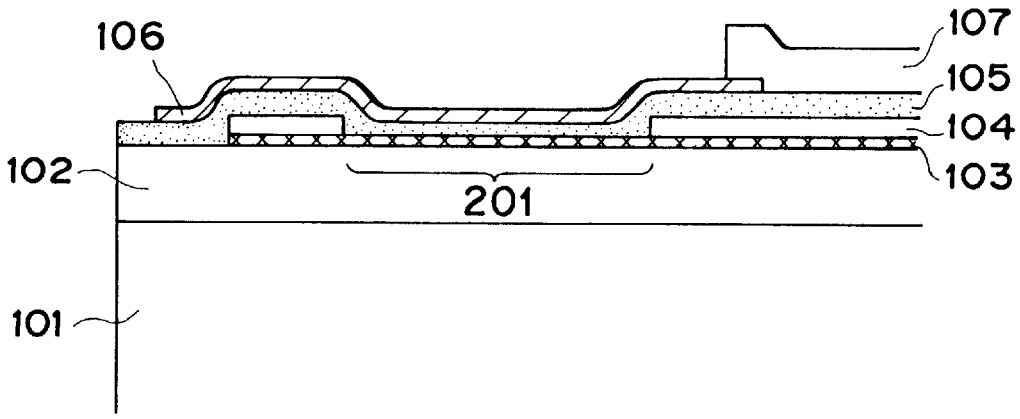
FIG. 2 is a cross-sectional view taken in the line X–Y of FIG. 1.
Figure 3:
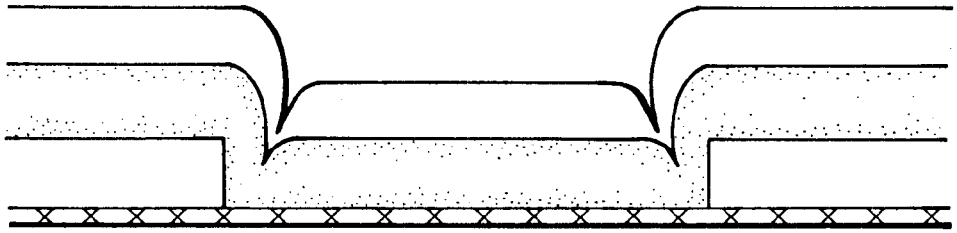
FIG. 3 is a cross-sectional view schematically showing a heating portion and its vicinity according to a conventional technique.

FIG. 1 is a schematic diagram showing a heater board according to the present invention, and FIG. 2 is a cross-sectional view taken in the line X–Y of FIG. 1.

A heat accumulating layer 102 is formed on a substrate 101. A heating resistor layer 103 serves as an electrothermal energy conversion element electrodes 104 are sequentially formed on the substrate 101. The portion 201 of the heating resistor layer 103 which is not covered with the electrodes 104 acts as a heating portion. The thermal energy generated in the heating portion is utilized to discharge liquid droplets. The above-described electrothermal energy conversion element is covered with an upper protection layer. The upper protection layer comprises a first protection layer 105 for electrical insulation between the ink and the electrothermal energy conversion element, a second protection layer 106 for preventing the damage due to cavitation which occurs when bubbles disappear, and a third protection layer 107 for preventing chemical change or corrosion due to the contact with ink.

Preferable materials for the above elements are as follows: silicon or alumina for the substrate; $SiO_2$, $Si_3N_4$ for the heat accumulating layer (0.5–5.0 $\mu$m); $HfB_2$, $Ta_2N$ for the electrothermal energy conversion element (heating resistor layer) (0.01–0.5 $\mu$m); Ti, Al for the electrodes (0.1–2 $\mu$m); $SiO_2$, $Si_3N_4$ for the first protection layer (0.5–2 $\mu$m); Ta, Ti for the second protection layer (0.1–1.0 $\mu$m); and photosensitive polyimide, photosensitive acrylic for the third protection layer.

Figure 4:
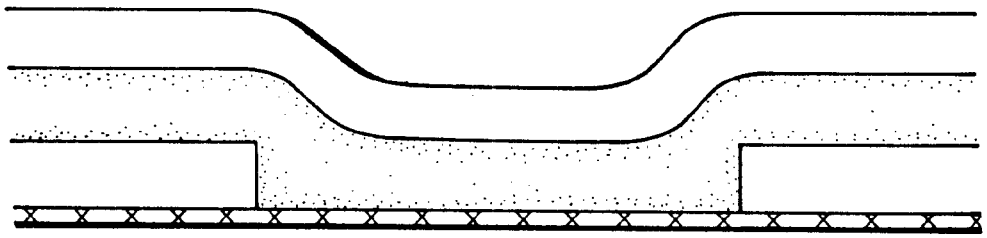
FIG. 4 is a cross-sectional view schematically showing a heating portion and its vicinity according to the present invention.

In a common known technique, the protection layer for a heater board of this type is formed by means of sputtering or CVD, and it is difficult to produce an ink-jet print head having good step coverage which can perform good thermal response with a high production yield, as described above. In contrast, the present invention employs a CVD technique using an organic silicon source as source gas to form a protection layer. According to this technique of the present invention, with good step coverage as shown in FIG. 4 it is possible to form a film by using processes very similar to those in conventional techniques, and it is possible to produce an ink-jet print head with a high production yield.

In the CVD technique according to the present invention, the organic silicon source can be selected from TEOS (tetraethylortho silicate), OMCTS (octamethylcyclo tetrasiloxane), TMOS (tetramethoxy silane), TPOS (tetrapropoxy silane), DADBS (diacetoxyditertiary butoxysilane), HMDS (hexamethyldisiloxane), TMCTS (1,3,5,7-tetramethylcyclo tetrasiloxane), TMS (tetramethylsilane), and TES (triethylsilane). In the CVD technique according to the present invention, either plasma-enhanced CVD or atmospheric-pressure CVD can be successfully used to obtain a high quality film. However, these two CVD techniques are carried out at different substrate temperatures. Thus, the selection of these two techniques can be made from the viewpoint of the substrate temperature required to form the desired electrode material.

The reaction of the organic silicon source will be described below taking TEOS as an example. The molecular formula of TEOS is given by:

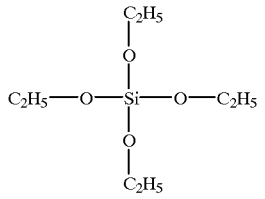

TEOS can be pyrolized to form an oxide film as shown below:

$$Si(OC_2H_5)_4 \rightarrow SiO_2 + 4C_2H_4 + 2H_2O$$

However, while the use of organic silicon has been investigated for the application to semiconductor integrated circuits, detailed mechanism of the reaction of the organic silicon source to form the film is not known. A problem of this technique is poor controllability of the film. Because the growth of a film strongly depends on the underlying material, pattern geometry, and film forming temperature, it is very difficult to obtain a uniform film. On the other hand, in the fields other than semiconductor integrated circuits, there has been very little investigation on the CVD technology with the organic silicon source. Considering the fact that the properties of a deposited film is strongly influenced by the underlying material or the like, it is not possible to discuss both the underlying materials for semiconductor integrated circuits and the materials for use other than semiconductor integrated circuits in the same ground. It can be expected that the use of organic silicon source will bring about different effects which are inherent in the applications to which this technology is applied.

The inventors of the present invention have found out that if the CVD technique with the organic silicon source is applied to the heating element of an ink-jet print head, its durability against the ink discharge can be improved drastically. The films formed by the CVD with the organic silicon source have good step coverage, and if this film is used as an upper protection film to cover an electrothermal energy conversion element which generates thermal energy required for an ink-jet print head, this film acts as an excellent protection film. The present invention is based on this knowledge which has not been known at all in conventional technologies.

It has also been found out that when the upper protection film for an ink-jet print head is made by the CVD technique using the organic silicon based source.

If the substrate temperature is too low when forming the film or if the ratio amount of the organic silicon source in the raw gas mixture is too large, the durability against the ink discharge of the film becomes poor.

The reason for this can be understood that under such conditions the organic silicon source cannot react enough, and thus Si—OH bonds remain in the film. To obtain good enough quality as a protection film for an ink-jet print head, a dense film which is stable at high temperatures is required. If the film contains Si—OH bonds as described above, Si—OH bonds are unstable and thus such a film tends to show degradation due to aging effects. Moreover, such a film also tends to be porous. Therefore, when a protection film for an ink-jet print head is made by the CVD technique using the organic silicon based source, it is desirable to form a film which contains no Si—OH bonds. More specifically, preferable conditions to achieve such a film are as follows: in the plasma-enhanced CVD, the substrate temperature during film deposition is equal to or more than 100° C., and the gas flow rate as defined by $H_2O$/organic silicon source is equal to or more than 0.01; and in the atmospheric-pressure CVD, the substrate temperature during film deposition is equal to or more than 350° C., and the gas flow rate as defined by $O_3$/organic silicon source is equal to or more than 0.01. Under these conditions, it is possible to obtain a protection film which does not substantially contain Si—OH bonds.

On the other hand, if the substrate temperature is too high, or if the amount of the organic silicon source is too large relative to the other gases, the residual stress of the film becomes too large, which causes the separation of the film from the substrate. Therefore, it is desirable to form the film under the conditions described below. That is, in the plasma-enhanced CVD, the substrate temperature during the film deposition should be less than 350° C., and the gas flow rate as defined by $H_2O$/ organic silicon source should be less than 1, and in the atmospheric-pressure CVD, the substrate temperature during the film deposition should be less than 600° C., and the gas flow rate as defined by $O_3$/organic silicon source should be less than 1.

Regarding the conditions other than those described above, for the plasma-enhanced CVD, a preferable gas pressure is in the range from 0.1 to 10 Torr, a preferable substrate temperature is in the range from 100° C. to 350° C., and a preferable discharging power is in the range from 0.5 kW to 2 kW, and for the atmospheric-pressure CVD, a preferable gas pressure is 760 Torr, and a preferable substrate temperature is in the range from 350° C. to 600° C. In each case, a preferable deposition rate is in the range from 0.01 $\mu$m/min to 0.1 $\mu$m/min.

The structures and operation principles of typical ink-jet print heads to which the present invention is applicable are disclosed, for example, in U.S. Pat. Nos. 4,723,129 and 4,740,796, and the present invention can be advantageously applied to those ink-jet print heads which are based on the principles disclosed there. The printing technique can be applicable either to the on-demand type or the continuous type.

The printing technique will be briefly described below. An electrothermal energy conversion element is disposed at a proper position corresponding to a sheet holding liquid (ink) and to a liquid flow path. At least one driving signal corresponding to the information to be printed is applied to the electrothermal energy conversion element so as to generate large thermal energy to raise the temperature rapidly enough so that film boiling exceeding nuclear boiling can occur at the heating plate of the print head. This technique is especially suitable for the on-demand printing, because it is possible to generate the bubbles from the liquid (ink) maintaining the one-to-one correspondence between the bubble and the driving signal applied to the electrothermal energy conversion element. By means of growth and elimination of the bubbles, the liquid (ink) is discharged through a discharge orifice, and at least one bubble is created. If a pulse signal is used as the driving signal, then it becomes possible to instantaneously grow or eliminate a bubble. Thus, the use of the pulse signal is more preferable, because it is possible to achieve the rapid response in discharge of liquid (ink). The driving signal having a preferable pulse-shape is disclosed in U.S. Pat. Nos. 4,463,359 and 4,345,262. Furthermore, if the conditions associated with the temperature rising rate at the heating plate, disclosed in U.S. Pat. No. 4,313,124, is employed, then it becomes possible to achieve higher quality printing.

In addition to the print heads having the structure of the combination of the discharge orifice, the liquid flow path, and the electrothermal energy conversion element (straight-line liquid flow path or right-angle liquid flow path) which are disclosed in the above-cited U.S. Patents, the present invention can also be applied to a print head having such a structure in which the heating portion is disposed in the bending region as disclosed in U.S. Pat. No. 4,459,600.

Furthermore, the present invention is also useful in the application to such an arrangement in which a slit is provided as a discharge orifice for common use for a plurality of electrothermal energy conversion elements as disclosed in Japanese Patent Application Laid-Open No. 59-123670, and to the arrangement in which an orifice, which absorbs the pressure wave due to the thermal energy, is provided corresponding to the discharge portion as disclosed in Japanese Patent Application Laid-Open No. 59-138461.

Still furthermore, the present invention can also be applied to a full-line type print head which has a length corresponding to the maximum printing width of a printing medium. The full-line type print head may be configured with a plurality of print heads of the types disclosed in the above-cited patents, or alternatively, it may also be configured with one integrally-formed full-line print head.

In addition, the present invention can also be applied to an exchangeable chip type print head which is used by attaching it to the major portion of a printing apparatus so that required electrical connections or supply of ink from the major portion may be achieved. The present invention can also be applied to an integrated-formed cartridge type print head.

A printing apparatus according to the present invention may become more preferable if recovering means for the printing head or other auxiliary or preliminary means is added so as to achieve more stable use. More specifically, such means to achieve better printing includes a capping means for capping a print head, cleaning means, high pressure or suction means, preliminary heating means using the electrothermal energy conversion element or a heating element provided separately from the electrothermal energy conversion element or a combination of these, and preliminary discharge means for performing discharge in a preliminary discharge mode in addition to a printing mode.

Furthermore, the present invention may also be applied with extreme advantage to a printing apparatus which has an integrated-form print head or a combination of a plurality of print heads so as to achieve multi-color or mixed-color printing in addition to unicolor printing such as black.

In the embodiments described above, it has been described that ink is liquid. However, such ink which is solid at room temperature or ink which can be softened at room temperature may also be used in the present invention. In ink-jet printing apparatus, it is the most common that the ink is controlled to maintain a proper temperature in the range from 30° C. to 70° C. so that the ink may have proper viscosity which can give stable discharge. Therefore, any types of ink may be used as long as the ink may become liquid when it is actually used in printing.

Moreover, the ink which is solid at room temperature may be preferable in that the ink can prevent an excess increase in temperature of a head or ink itself by effectively using the thermal energy to alter the ink from a solid state to a liquid state. The ink which becomes solid when it is not used may also be useful because evaporation of ink can be effectively prevented. The ink which becomes liquid by means of thermal energy, such as the ink which becomes liquid when the thermal energy corresponding to the printing signal is applied to the ink and thus is discharged, or the ink which starts to become solid before the ink arrives at a printing medium may also be used in the present invention.

The ink may also be used in such a manner that the ink is held in a solid or liquid state in the recess or the through-hole in a porous sheet material at a position opposed to the electrothermal energy conversion element as disclosed in Japanese Patent Application Laid-Open No. 54-56847.

For each type of ink described above, the most preferable technique is the film boiling technique according to the present invention.

Figure 5:
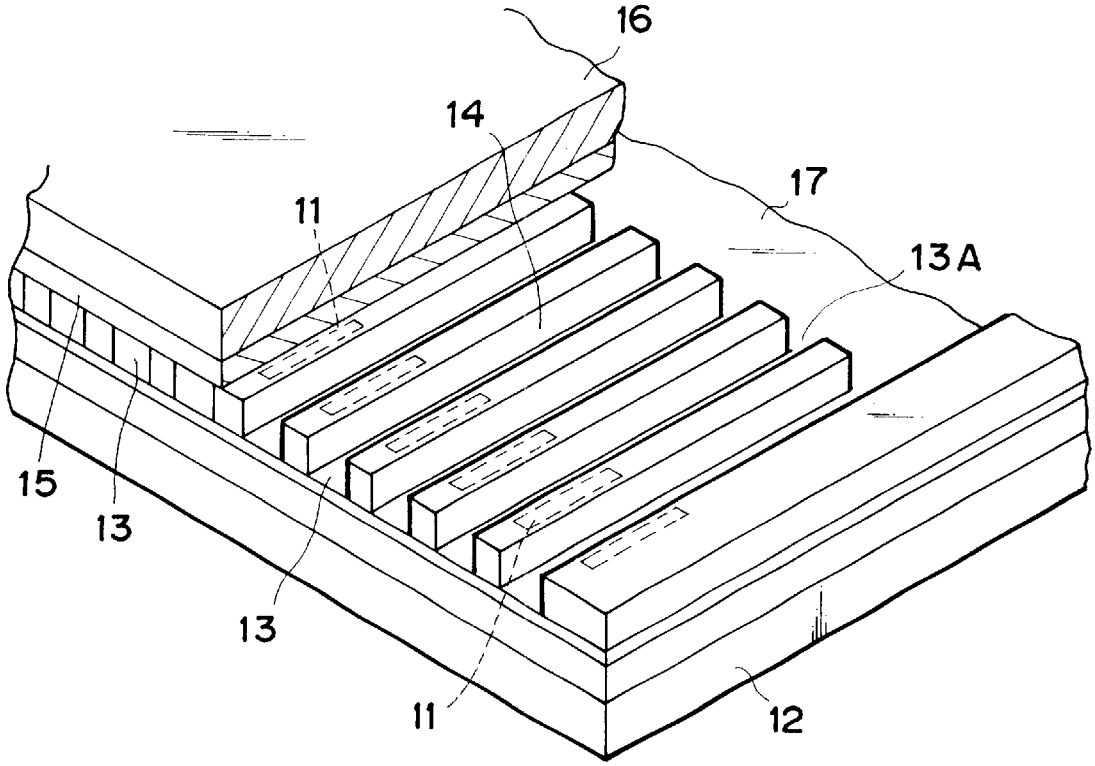
FIG. 5 is a perspective view showing an ink-jet print head embodying the present invention.

FIG. 5 is a perspective view showing an ink-jet print head to which the present invention can be applied. In FIG. 5, reference numeral 11 denotes a heating portion (also referred to as heat generating element) comprising an electrothermal energy conversion element which generates thermal energy responsible to the applied electrical signal and thus generates a bubble in ink. Thus, the ink is discharged. Reference numeral 12 denotes a substrate (also referred to as a heater board) on which the heating portions 11 are formed by production processes similar to those used in semiconductor production. Reference numeral 13 denotes a discharge aperture (also referred to as an orifice), and reference numeral 14 denotes an ink flow path (also referred to as a nozzle) extending to the discharge aperture 13. Reference numeral 15 denotes an ink flow path forming element for forming the discharge aperture 13 and for forming the ink flow path 14.

In FIG. 5, there are also shown a top plate 16, and a common ink chamber 17 connected to each ink flow path 14. The ink chamber 17 stores the ink supplied from an ink supply source (not shown). In this example, the top plate and the ink flow path forming element are formed as separate members. However, these elements may also be integrally formed by using a thermoplastic material such as polysulfone. Furthermore, an orifice plate may also be provided at the orifice portion.

Figure 6:
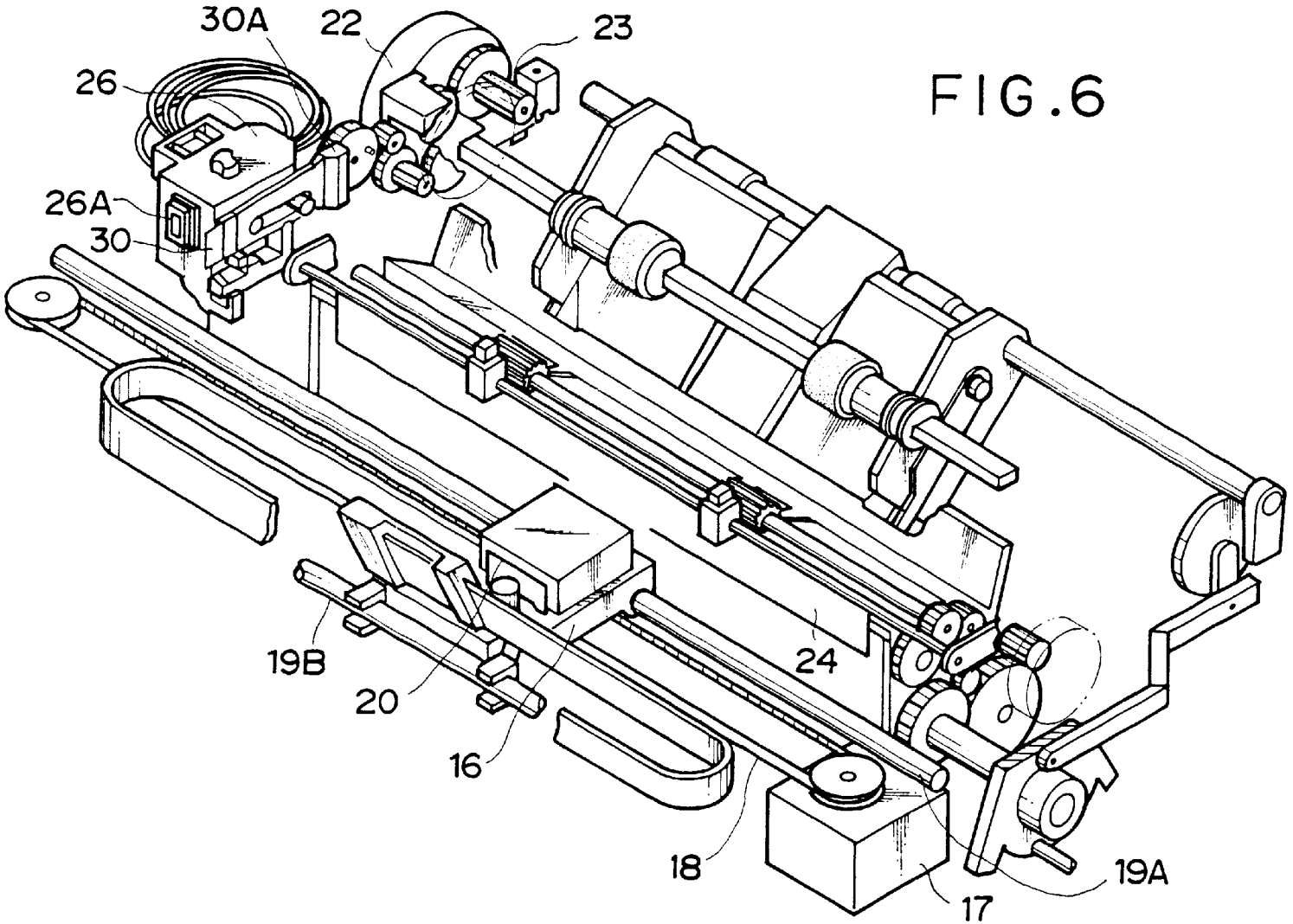
FIG. 6 is a perspective view showing a printing apparatus with an ink-jet print head according to the present invention.

FIG. 6 is a perspective view showing the outline of an example of an ink-jet printing apparatus having an ink-jet head cartridge (IJC) according to the present invention.

In FIG. 6, reference numeral 20 denotes an ink-jet head cartridge (IJC) having a set of nozzles for discharging the ink to a recording medium or printing sheet conveyed onto a platen 24. Reference numeral 16 denotes a holding carriage HC for holding the IJC 20. The holding carriage 16 is connected to a portion of a driving belt 18 which is used to transmit the driving force of a driving motor 17. The holding carriage 16 can reciprocally move across the entire width of the printing sheet by sliding along two guide shafts 19A and 19B which are provided parallel to each other.

Reference numeral 26 denotes a head recovery device disposed at one end of the moving path of the IJC 20, for example at a position opposed to the home position. The head recovery device 26 is moved so as to cap the IJC 20 by the force of the motor 22 transmitted via a transmission mechanism 23. In association with capping by a cap portion 26A of the head recovery device 26 to the IJC 20, ink is sucked by suitable suction means provided in the head recovery device 26 and pressed by suitable press means provided in an ink supply route to the IJC 20 so that ink is forcibly exhausted from the discharge port to perform discharge recovery process, such as removing ink having increased viscosity in the nozzle. Additionally, the IJC 20 is protected by capping when recording is terminated.

Reference numeral 30 denotes a wiping member or blade made up of silicone rubber which is disposed on the side of the head recovery device 20. The blade 31 is fixed to the head recovery device 26 with a blade holder 31A having a form of a cantilever. As in the case of the head recovery device 26, the blade 31 is also operated by the motor 22 and the transmission mechanism 23 to engage with the discharge port surface of the IJC 20. By this arrangement, blade 31 is pushed out in a travelling path of the IJC 20 at a suitable timing in the recording operation of the IJC 20 or after the discharge recovery process by the head recovery device 26 so that the wiper blade 31 wipes out the dust, moisture condensation, wet contaminant, and the like, on the discharge port surface of the IJC 20 in accordance with the movement of the IJC 20.

ILLUSTRATIVE EXAMPLES

Illustrative examples according to the present invention will be described below.

Examples 1.1–1.5, 2.1–2.5

First, a 2.0 $\mu$m thick $SiO_2$ layer to be used as a heat accumulating layer 102 is formed on a silicon substrate 101. Then, a 0.1 $\mu$m thick $HfB_2$ layer to be used as a heating resistor layer 103 is deposited by sputtering. Furthermore, as the electrode layer 104 a 0.005 $\mu$m thick Ti layer and then a 0.6 $\mu$m thick Al layer are successively deposited by means of evaporation. Then, a circuit pattern serving as a heating element 201 such as that shown in FIG. 1 is formed in the area of 30 $\mu$m×150 $\mu$m by means of photolithography. A 0.6 $\mu$m thick $SiO_2$ layer serving as the first protection layer 105 is deposited by means of plasma-enhanced CVD using the raw gases shown in Table 1 under the conditions also shown in Table 1. Furthermore, a 0.5 $\mu$m thick Ta layer serving as the second protection layer is formed by sputtering, and then bar-shaped patterns such as those shown in FIG. 1 are formed in the Ta layer by means of photolithography. Then, a photosensitive polyimide layer serving as the third protection layer 107 is coated to form patterns such as those shown in FIG. 1. In this way, a heater board is completed. To obtain a complete ink-jet print head, a top plate having grooves with orifice blades comprising polysulfone in which a recess for forming the ink flow path and the common liquid chamber is integrally formed by means of injection molding, is bonded to the heater board.

and the common liquid chamber is integrally formed by means of injection molding is bonded to the heater board.

Comparative Examples

In this case, the first protection layer 105 of $SiO_2$ was formed by means of plasma-enhanced CVD using the raw gases shown in Table 1 under the conditions also shown in Table 1. The thicknesses of the layer are 0.6 $\mu$m for the comparative example 1 (Table 2), and 2.0 $\mu$m for the comparative example 2 (Table 2). The ink-jet print heads were completed in the same manner as the example 1.1 except for the first protection layer.

TABLE 1

| Example No. | Film Formation Method | Gas Pressure (Torr) | Substrate Temperature (° C.) | Gas 1 | Gas 2 | Flow Rate of Gas 1 (sccm) | Flow Rate of Gas 2 (sccm) | Discharging Power (kW) | Deposition Rate ($\mu$m/min) |
|---|---|---|---|---|---|---|---|---|---|
| 1.1 | PLASMA CVD | 1 | 150 | TEOS | $H_2O$ | 100 | 10 | 1 | 0.02 |
| 1.2 | PLASMA CVD | 1 | 150 | TEOS | $H_2O$ | 100 | 100 | 1 | 0.02 |
| 1.3 | PLASMA CVD | 1 | 350 | TEOS | $H_2O$ | 100 | 10 | 1 | 0.02 |
| 1.4 | PLASMA CVD | 1 | 150 | TEOS | $H_2O$ | 100 | 150 | 1 | 0.02 |
| 1.5 | PLASMA CVD | 1 | 90 | TEOS | $H_2O$ | 100 | 10 | 1 | 0.02 |
| 1.6 | ATMOSPHERIC PRESSURE CVD | 760 | 450 | TEOS | $O_3$ | 500 | 30 | — | 0.03 |
| 1.7 | ATMOSPHERIC PRESSURE CVD | 760 | 450 | TEOS | $O_3$ | 500 | 5 | — | 0.03 |
| 1.8 | ATMOSPHERIC PRESSURE CVD | 760 | 350 | TEOS | $O_3$ | 500 | 30 | — | 0.03 |
| 1.9 | ATMOSPHERIC PRESSURE CVD | 760 | 450 | TEOS | $O_3$ | 500 | 4 | — | 0.03 |
| 1.10 | ATMOSPHERIC PRESSURE CVD | 760 | 650 | TEOS | $O_3$ | 500 | 30 | — | 0.03 |
| 2.1 | PLASMA CVD | 1 | 150 | OMCTS | $H_2O$ | 100 | 30 | 1 | 0.02 |
| 2.2 | PLASMA CVD | 1 | 150 | OMCTS | $H_2O$ | 100 | 15 | 1 | 0.02 |
| 2.3 | PLASMA CVD | 1 | 100 | OMCTS | $H_2O$ | 100 | 30 | 1 | 0.02 |
| 2.4 | PLASMA CVD | 1 | 150 | OMCTS | $H_2O$ | 100 | 110 | 1 | 0.02 |
| 2.5 | PRASMA CVD | 1 | 400 | OMCTS | $H_2O$ | 100 | 30 | 1 | 0.02 |
| 2.6 | ATMOSPHERIC PRESSURE CVD | 760 | 400 | OMCTS | $O_3$ | 500 | 30 | — | 0.02 |
| 2.7 | ATMOSPHERIC PRESSURE CVD | 760 | 400 | OMCTS | $O_3$ | 500 | 500 | — | 0.02 |
| 2.8 | ATOMOSPHERIC PRESSURE CVD | 760 | 600 | OMCTS | $O_3$ | 500 | 30 | — | 0.02 |
| 2.9 | ATOMOSPHERIC PRESSURE CVD | 760 | 400 | OMCTS | $O_3$ | 500 | 3 | — | 0.02 |
| 2.10 | ATOMOSPHERIC PRESSURE CVD | 760 | 300 | OMCTS | $O_3$ | 500 | 30 | — | 0.02 |
| Comparative Example | PLASMA CVD | 2 | 300 | $SiH_4$ | $N_2O$ | 200 | 30 | 1 | 0.02 |

Examples 1.6–1.10, 2.6–2.10

First, a 2.0 $\mu$m thick $SiO_2$ layer to be used as a heat accumulating layer 102 is formed on a silicon substrate 101. Then, a 0.1 $\mu$m thick $HfB_2$ layer to be used as a heating resistor layer 103 is deposited by sputtering. Furthermore, as the electrode layer a 0.005 $\mu$m thick Ti layer and then a 0.6 $\mu$m thick Al—Cu layer are successively deposited by means of evaporation. Then, a circuit pattern serving as a heating element 201 such as that shown in FIG. 1 is formed in the area of 30 $\mu$m×150 $\mu$m by means of photolithography. A 0.6 $\mu$m thick $SiO_2$ layer serving as the first protection layer 105 is deposited by means of atmospheric-pressure chemical vapor deposition using the raw gases shown in Table 1 under the conditions also shown in FIG. 1. Furthermore, a 0.5 $\mu$m thick Ta layer serving as the second protection layer 106 is formed by sputtering, and then bar-shaped patterns such as those shown in FIG. 1 are formed in the Ta layer by means of photolithography. Then, a photosensitive polyimide layer serving as the third protection layer 107 is coated to form patterns such as those shown in FIG. 1. In this way, a heater board is completed. To obtain a complete ink-jet print head, a top plate having grooves with orifice blades comprising polysulfone in which a recess for forming the ink flow path The step coverage of the protection layers over the electrodes near the heaters was evaluated for these heads. The film quality in the step regions was evaluated by inspection after the film was soft-etched. Almost no etching was observed in the step regions for all the films of examples 1.1–1.10, and 2.1–2.10, which means that the film quality of these films is excellent. In contrast, in the film of the comparative example 1 the step regions were removed off due to the soft-etching. The film of the comparative example 2 was also etched although the step regions remained. It was found out that these films made by conventional techniques did not have good quality.

The discharge durability test was carried out for these ink-jet print head.

The testing conditions were as follows: the driving frequency was 3 kHz, the pulse width was 10 $\mu$s, the driving voltage was 1.2 times larger than the foaming voltage. The signals of $5\times10^7$ and $1\times10^9$ pulses were applied. The test was carried out on 500 bits for each head. The results are shown in Table 2.

If there is no disconnection observed in a head after the $5\times10^7$ pulses have been applied, then the head exhibits durability sufficient for general use in a printer. If there is no disconnection observed in a head after the $1\times10^9$ pulses have been applied, then the head has high enough quality which can be used for extremely frequent use particularly as in printing of image information.

As shown in Table 2, even after applying $1\times10^9$ pulses, no disconnection was observed for any of the heads of the examples 1.1–1.3, 1.6–1.8, 2.1–2.3, and 2.6–2.8, which means these heads have excellent durability. The examples 1.4–1.5, 1.9–1.10, 2.4–2.5, and 2.9–2.10 did not show any disconnection after $5\times10^7$ pulses were applied, however disconnections were observed after $1\times10^9$ pulses were applied. This is probably because the films of examples 1.5, 1.9, 2.9, and 2.10 contained some Si—OH bonds. It can also be understood that the failures of examples 1.4, 1.10, 2.4, and 2.5 were due to the large residual stress. On the other hand, disconnections were observed for both comparative examples 1 and 2 in the both cases of $5\times10^7$ pulses and $1\times10^9$ pulses.

In conclusion, the ink-jet print heads having the upper protection layer made by CVD using organic silicon as source gas have high performance in discharge durability and in thermal response.

TABLE 2

| Example (Sample) | $5 \times 10^7$ | $1 \times 10^9$ |
|---|---|---|
| 1.1 | ○ | ○ |
| 1.2 | ○ | ○ |
| 1.3 | ○ | ○ |
| 1.4 | ○ | x |
| 1.5 | ○ | x |
| 1.6 | ○ | ○ |
| 1.7 | ○ | ○ |
| 1.8 | ○ | ○ |
| 1.9 | ○ | x |
| 1.10 | ○ | x |
| 2.1 | ○ | ○ |
| 2.2 | ○ | ○ |
| 2.3 | ○ | ○ |
| 2.4 | ○ | x |
| 2.5 | ○ | x |
| 2.6 | ○ | ○ |
| 2.7 | ○ | ○ |
| 2.8 | ○ | ○ |
| 2.9 | ○ | x |
| 2.10 | ○ | x |
| Comparative Example 1 | x | x |
| Comparative Example 2 | x | x |

○ No Disconnection
x Disconnected

What is claimed is:

1. A method of manufacturing an ink jet head comprising a substrate, an ink discharge port for discharging ink, an electrothermal converting element provided on the substrate to generate energy utilized for discharging ink, a liquid flow path aligned with the electrothermal converting element and communicating with the ink discharge port and an upper protective layer on the electrothermal converting element to protect the electrothermal converting element from the ink in the liquid flow path, comprising the steps of:

providing an organic silicon source as raw material gas for a CVD method, and using the CVD method to form a silicon oxide thin film on an upper portion of the electrothermal converting element as the upper protective layer, wherein said silicon oxide film contains almost no Si—OH bonds.

2. A method of manufacturing an ink jet head according to claim 1, wherein said organic silicon source is tetraethylortho silicate, octamethylcyclo tetrasiloxane, tetramethoxy silane, tetrapropoxy silane, diacetoxyditertiary butoxysilane, hexamethyldisiloxane, 1,3,5,7-tetramethylcyclo tetrasiloxane, tetramethylsilane or triethylsilane.

3. A method of manufacturing an ink jet head according to claim 1, wherein said head is a full-line type head having a plurality of discharge ports which are disposed along the portion corresponding to a full size of a width of a printing medium.

4. A method of manufacturing an ink jet printing apparatus comprising the steps of providing at least an ink jet head manufactured according to claim 1, disposing said head in such a manner that the ink discharge port is opposed to a printing plane of a printing medium, and connecting said head to said apparatus.

5. A method of manufacturing an ink jet head according to claim 1, wherein the thickness of said upper protective layer is 0.5–2 $\mu$m.

6. A method of manufacturing an ink jet head according to claim 1, wherein said CVD method is a plasma CVD method.

7. A method of manufacturing an ink jet head according to claim 1, wherein said CVD method is a normal pressure CVD method.

8. A method of manufacturing an ink jet head according to claim 1, said upper protective layer further comprising an anti-cavitation layer on a heat generating portion of said electrothermal converting element.

9. A method of manufacturing an ink jet head according to claim 8, wherein said anti-cavitation layer is formed of tantalum.

10. A method of manufacturing an ink jet head comprising a substrate, an ink discharge port for discharging ink, an electrothermal converting element provided on the substrate to generate energy utilized for discharging ink, a liquid flow path aligned with the electrothermal converting element and communicating with the ink discharge port and a protective layer on the electrothermal converting element to protect the electrothermal converting element from the ink in the liquid flow path, comprising the steps of:

providing an organic silicon source as a first raw material gas for a plasma CVD method, and using the plasma CVD method to form a silicon oxide thin film on an upper portion of the electrothermal converting element as the protective layer, wherein a second raw material gas is $H_2O$ and during said plasma CVD method a temperature of the substrate is 100 to 350° C. and a ratio of the flow rates of the second raw material gas to the organic silicon source gas is 0.01 to 1, and wherein the protective layer contains almost no Si—OH bonds.

11. A method of manufacturing an ink jet head comprising a substrate, an ink discharge port for discharging ink, an electrothermal converting element provided on the substrate to generate energy utilized for discharging ink, a liquid flow path aligned with the electrothermal converting element and communicating with the ink discharge port and a protective layer on the electrothermal converting element to protect the electrothermal converting element from the ink in the liquid flow path, comprising the steps of:

providing an organic silicon source as a first raw material gas for a normal pressure CVD method, and using the CVD method to form a silicon oxide thin film on an upper portion of the electrothermal converting element as the protective layer, wherein a second raw material gas is $O_3$ and during said normal pressure CVD method a temperature of the substrate is 350 to 600° C. and a ratio of the flow rates of the second raw material gas to the organic silicon source is 0.01 to 1, and wherein the protective layer contains almost no Si—OH bonds.

* * * * *

UNITED STATES PATENT AND TRADEMARK OFFICE

CERTIFICATE OF CORRECTION

PATENT NO. : 6,352,338 B1
DATED : March 5, 2002
INVENTOR(S) : Hirokazu Komuro

It is certified that error appears in the above-identified patent and that said Letters Patent is hereby corrected as shown below:

Title page,
Item [56], References Cited, U.S. PATENT DOCUMENTS, "Rahgappan" should read -- Rangappan --; and Column 5,
Line 16, "when" should be deleted.

Signed and Sealed this

Fourth Day of June, 2002

*Attest:*

*Attesting Officer*

JAMES E. ROGAN
*Director of the United States Patent and Trademark Office*